US011542063B2

(12) United States Patent
Braverman et al.

(10) Patent No.: US 11,542,063 B2
(45) **Date of Patent: *Jan. 3, 2023**

(54) MULTI-COMPARTMENT ARTICLE DISPENSING PACKAGE

(71) Applicant: Medi-Dose, Inc., Ivyland, PA (US)

(72) Inventors: Robert Braverman, Warrington, PA (US); Donald A. Lawson, Harleysville, PA (US)

(73) Assignee: Medi-Dose, Inc., Ivyland, PA (US)

( * ) Notice: Subject to any disclaimer, the term of this patent is extended or adjusted under 35 U.S.C. 154(b) by 82 days.

This patent is subject to a terminal disclaimer.

(21) Appl. No.: 17/232,622

(22) Filed: Apr. 16, 2021

(65) Prior Publication Data

US 2021/0229862 A1 Jul. 29, 2021

Related U.S. Application Data

(63) Continuation of application No. 16/369,767, filed on Mar. 29, 2019, now Pat. No. 10,994,891, which is a (Continued)

(51) Int. Cl.
*B65D 21/02* (2006.01)
*B65D 77/20* (2006.01)

(Continued)

(52) U.S. Cl.
CPC ..... *B65D 21/0206* (2013.01); *A61J 1/00* (2013.01); *A61J 1/03* (2013.01); *B65D 75/527* (2013.01);

(Continued)

(58) Field of Classification Search
CPC ..... B65D 21/0206; B65D 75/527; B65D 77/2024; B65D 77/22; B65D 75/327; A61J 1/00; A61J 1/03; A61J 1/035

(Continued)

(56) References Cited

U.S. PATENT DOCUMENTS 2,138,241 A * 11/1938 Koch ..... B65D 75/28 206/273
2,302,045 A 11/1942 Neumann et al.

(Continued)

FOREIGN PATENT DOCUMENTS

JP 2013141997 A 7/2013

OTHER PUBLICATIONS

English Language Abstract for JP 2013141997A published Jul. 22, 2013.

(Continued)

*Primary Examiner* — J. Gregory Pickett
*Assistant Examiner* — Jenine Pagan
(74) *Attorney, Agent, or Firm* — Caesar Rivise, PC

(57) ABSTRACT

A multi-compartment package for dispensing plural items is disclosed. The package includes plural individual sealed compartment units which are releasably secured to each other. Each compartment unit includes a flanged base from which a chamber depends. The chamber serves to hold an item to be dispensed and is surrounded by a flange. A closure member, in the form of a respective portion of a frangible cover sheet, is adhesively secured to the flange of each compartment unit. Each compartment unit includes at least one foldable tab in a corner of its flange, which can be folded down to enable the closure member to be removed from the compartment unit after the compartment unit is separated from other compartment units of the package.

13 Claims, 4 Drawing Sheets

Related U.S. Application Data continuation of application No. 15/950,777, filed on Apr. 11, 2018, now Pat. No. 10,259,613, which is a continuation of application No. 15/604,858, filed on May 25, 2017, now Pat. No. 9,963,265.

(60) Provisional application No. 62/502,908, filed on May 8, 2017.

(51) Int. Cl.

| | |
|---|---|
| ***B65D 77/22*** | (2006.01) |
| ***A61J 1/03*** | (2006.01) |
| ***A61J 1/00*** | (2006.01) |
| ***B65D 75/52*** | (2006.01) |

(52) U.S. Cl.
CPC ..... *B65D 77/2024* (2013.01); *B65D 77/22* (2013.01); *A61J 1/035* (2013.01)

(58) Field of Classification Search
USPC ..... 220/23.4; 206/528, 534.1, 534.2, 538
See application file for complete search history.

(56) References Cited

U.S. PATENT DOCUMENTS

| | | | | |
|---|---|---|---|---|
| 3,054,679 | A | 9/1962 | Bradford | |
| 3,503,493 | A | 3/1970 | Nagy | |
| 3,780,856 | A | 12/1973 | Braverman | |
| 3,933,245 | A | 1/1976 | Mullen | |
| 3,976,196 | A | 8/1976 | Mueller | |
| 4,122,651 | A | 10/1978 | Braverman | |
| 4,196,809 | A | 4/1980 | Tonrey | |
| 4,211,329 | A | 7/1980 | Braverman | |
| 4,316,541 | A | 2/1982 | Braverman et al. | |
| 4,322,930 | A | 4/1982 | Braverman | |
| 4,416,375 | A | 11/1983 | Braverman et al. | |
| 4,429,792 | A | 2/1984 | Machbitz | |
| 4,673,086 | A | 6/1987 | Braverman et al. | |
| 5,393,032 | A | 2/1995 | Cederroth | |
| 5,409,127 | A | 4/1995 | Stratford et al. | |
| 5,775,505 | A | 7/1998 | Vasquez et al. | |
| 6,155,423 | A * | 12/2000 | Katzner | B65D 75/327 206/534 |
| 7,121,410 | B2 | 10/2006 | Rohrmus et al. | |
| 7,316,317 | B2 | 1/2008 | Harper | |
| 8,397,914 | B1 | 3/2013 | Janichek, Jr. et al. | |
| 9,963,265 | B1 | 5/2018 | Braverman et al. | |
| 10,259,613 | B2 * | 4/2019 | Braverman | B65D 75/327 |
| 10,994,891 | B2 * | 5/2021 | Braverman | A61J 1/00 |
| 2002/0045184 | A1 | 4/2002 | Chen | |
| 2002/0104773 | A1 | 8/2002 | Kalvelage et al. | |
| 2003/0111379 | A1 | 6/2003 | Intini | |
| 2003/0141218 | A1 | 7/2003 | Stephens et al. | |
| 2007/0289893 | A1 | 12/2007 | Williams, Jr. | |
| 2008/0289989 | A1 | 11/2008 | Kalvelage et al. | |
| 2013/0081968 | A1 * | 4/2013 | Kurtze | B65D 17/06 206/461 |
| 2015/0368018 | A1 * | 12/2015 | Broedsgaard | B65D 75/367 53/478 |
| 2016/0143808 | A1 * | 5/2016 | Pattison | B65D 17/4011 53/410 |

OTHER PUBLICATIONS

Supplementary European Search Report dated Mar. 13, 2020 for EP 18 79 8313.

* cited by examiner

MULTI-COMPARTMENT ARTICLE DISPENSING PACKAGE

CROSS-REFERENCE TO RELATED APPLICATIONS

This application is a continuation of application Ser. No. 16/369,767, filed on Mar. 29, 2019, entitled Multi-Compartment Article Dispensing Package, which in turn is a continuation of application Ser. No. 15/950,777, filed on Apr. 11, 2018, entitled Multi-Compartment Article Dispensing Package, now, U.S. Pat. No. 10,259,613, which in turn is a continuation of application Ser. No. 15/604,858, filed on May 25, 2017, entitled Multi-Compartment Article Dispensing Package, now U.S. Pat. No. 9,963,265, which in turn claims priority from Provisional Application Ser. No. 62/502,908 filed on May 8, 2017 entitled Multi-Compartment Article Dispensing Package, all of which applications are assigned to the same assignee as the subject invention and whose entire disclosures are specifically incorporated by reference herein.

FIELD OF THE INVENTION

This invention relates generally to dispensing packages and more particularly multi-compartment packages for dispensing items therefrom.

BACKGROUND OF THE INVENTION

In U.S. Pat. No. 3,780,856 (Braverman) there is disclosed a medicinal dispensing device comprising a base member in the form of a plurality of flanges having corners and which are detachably connected to each other along predefined frangible lines so that each flange may be separated from the remaining flanges to form an individual dispensing unit. Each unit includes a chamber with an outer opening depending from the flange of the unit. The chamber is adapted to hold a drug, tablet, capsule, etc., in it. A continuous closure member is provided covering the chamber openings, with selected portions of the interior surface of the closure member being in contact with the flanges. The closure member is perforated along selected lines corresponding to the frangible flange lines of the base member. Portions of the interior surface of the closure member corresponding to the flanges are provided with a tacky adhesive coating which is in contact with the flanges to releasably secure the closure member onto the base member, such that each chamber and its surrounding flange is covered by a respective portion of the cover member to form a sealed compartment. Other areas of the interior surface of the closure member are non-tacky, e.g., include a liner patch, and cover the chamber openings. The sealed compartments are configured to be separated from each other along their frangible flange lines to produce separate sealed compartment units. At least one corner of each flange includes a cut-away area so that the existing corner of the closure member overlies the cut-away area to function as a lift tab to facilitate the removal, e.g., peeling, of the closure member from the flange of the sealed compartment unit to provide access to the contents of the chamber.

Other prior art medicinal dispensing devices, components thereof, and methods of manufacturing and assembling the same are found in the following United States Letters Patents: U.S. Pat. No. 4,122,651 (Braverman); U.S. Pat. No. 4,211,329 (Braverman); U.S. Pat. No. 4,316,541 (Braverman et al.); U.S. Pat. No. 4,322,930 (Braverman); U.S. Pat. No. 4,416,375 (Braverman et al.) and U.S. Pat. No. 4,673,086 (Braverman et al.)

While that prior art medicinal dispensing device of the aforementioned U.S. Pat. No. 3,780,856 is eminently suitable for its intended purposes it nevertheless leaves something to be desire from the standpoint of functionality and ease of assembling it. The subject invention addresses those needs.

All references cited herein are incorporated herein by reference in their entireties.

SUMMARY OF THE INVENTION

In accordance with one aspect of this invention there is provided a dispensing package for holding an item therein. The package is of square profile and comprises a cover sheet and a base member. The cover sheet comprises a plurality of closure members disposed in an array of at least two rows and two columns. The closure members are releasably secured to one another along frangible separation lines. The closure members are of a square profile. The base member has a plurality of individual compartment units releasably secured to one another and disposed in an array of at least two rows and two columns. Each compartment unit is of a square profile and comprises a flange and a chamber. The chamber is configured to hold an item therein and has an opening in communication with the chamber. The flange lies in a plane extending around the periphery of the chamber and has four corners. Adjacent ones of the compartment units merge together at a respective cruciform shaped frangible separation line extending through the planar member. The cruciform shaped frangible separation line includes respective portions of a selected corner of each of the compartment units. The selected corner of each of the compartment units includes a fold line contiguous with the cruciform shaped frangible separation line. The flanges of the multi-compartment base are detachably connected along frangible separation lines connecting the corners so that each compartment unit may be separated from the other compartment units. The cover sheet is configured to be releasably secured to the base member, whereupon the frangible separation lines of the cover sheet are coincident with the frangible separation lines of the base member and respective ones of the closure members are releasably secured to respective ones of the compartment units to form respective sealed compartment units with an item disposed therein. Each of the sealed compartment units is configured to be detached from the other sealed compartment units, whereupon the selected corner of the sealed compartment unit detached from the other sealed compartment units can be folded downward with respect to its closure member to enable the closure member to be grasped and removed from the sealed compartment unit to expose the item.

In accordance with one preferred aspect of this invention the cover sheet comprises an array of three rows and three columns and wherein the base member comprises an array of at least three rows and three columns of compartment units.

In accordance with another preferred aspect of this invention each of the closure members comprises an undersurface having an adhesive thereon, with the adhesive being configured to releasably secure the cover sheet to the base member.

In accordance with another preferred aspect of this invention the undersurface of each of the closure members includes a liner patch disposed over the opening of the chamber.

In accordance with another preferred aspect of this invention each of the compartment units includes two fold lines.

In accordance with another preferred aspect of this invention the square dispensing package includes four side edges and four outside corner compartments, each of the outside corner compartments being located at a respective corner of the dispensing package, and wherein each of the outside corner compartments includes a fold line located at a respective portion of a respective one of the side edges.

In accordance with another preferred aspect of this invention the cover sheet includes indicia thereon, with the indicia being configured to be located at respective portions of the cover sheet corresponding to the location of the foldable lines of the base member irrespective of the orientation of the cover sheet with respect to the base member.

In accordance with another preferred aspect of this invention each of the chambers comprises four side walls and a bottom wall, with the sidewalls tapering slightly inward toward each other in the direction towards the bottom wall, whereupon plural base members can be nested together.

In accordance with another preferred aspect of this invention each of the chambers includes a ledge portion located slightly below the opening and upon which the bottom wall of a base member nested therein is supported.

In accordance with another preferred aspect of this invention the cover sheet comprises an outer layer, a foil layer, an adhesive layer and a liner layer. The liner layer comprises plural liner patches covering the adhesive layer and located at respective opening of the base member.

In accordance with another preferred aspect of this invention the outer layer is formed of paper.

In accordance with another preferred aspect of this invention the outer layer is formed of a plastic material.

DETAILED DESCRIPTION OF THE PREFERRED EMBODIMENTS

Figure 1:
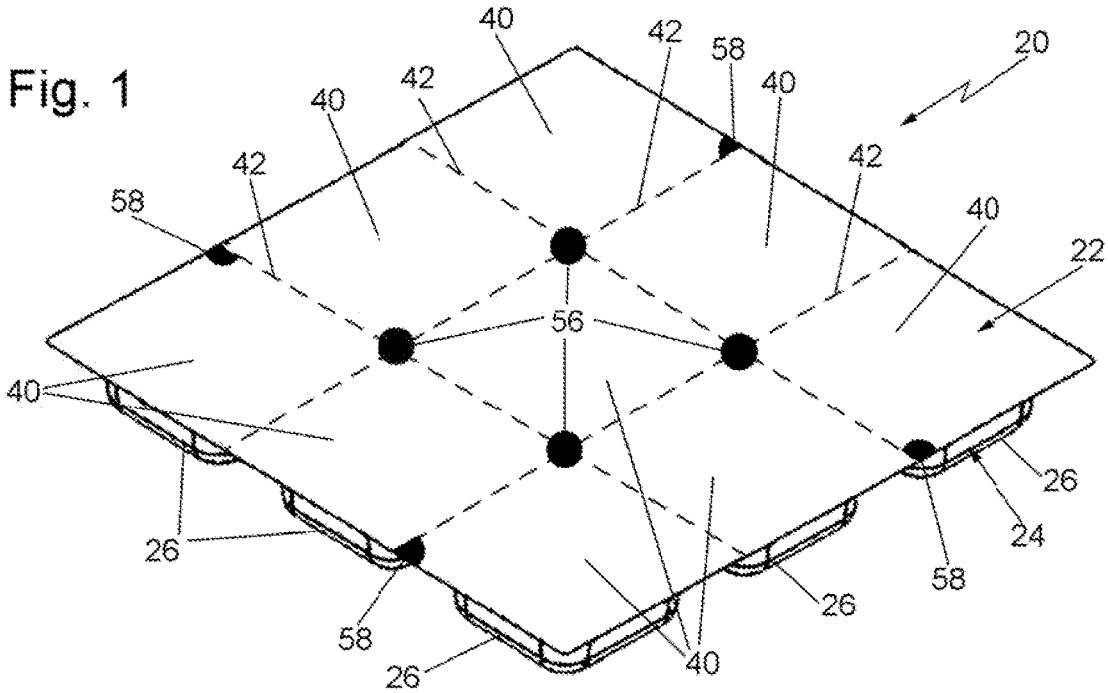
FIG. 1 is an isometric view of one exemplary embodiment of multi-compartment dispensing package constructed in accordance with this invention, wherein the package includes a frangible cover sheet made up of plural covers and a frangible multi-compartment base on which the cover sheet is adhesively secured.

Referring now to the various figures of the drawing wherein like reference characters refer to like parts, there is shown in FIG. 1 one exemplary embodiment of a multi-compartment dispensing package 20 constructed in accordance with this invention. The multi-compartment package basically comprises a cover sheet 22 and a base member 24.

Figure 2:
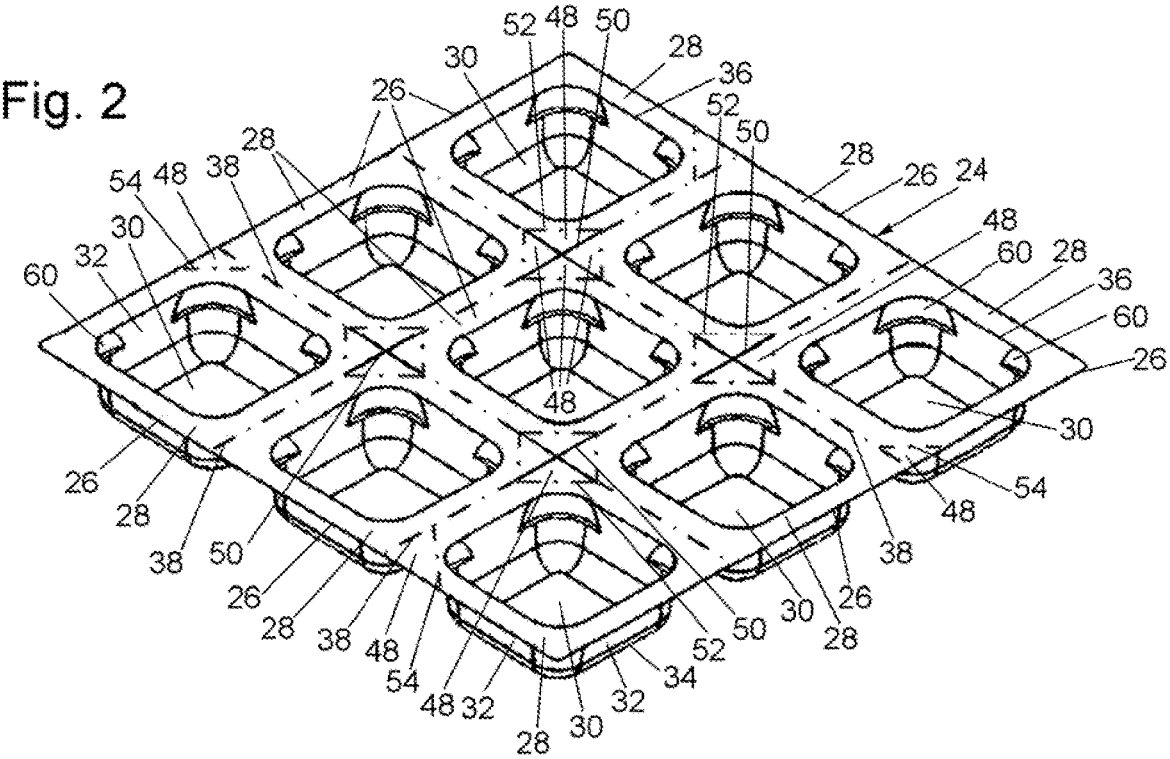
FIG. 2 is an isometric view of the multi-compartment base of FIG. 1.
Figure 3:
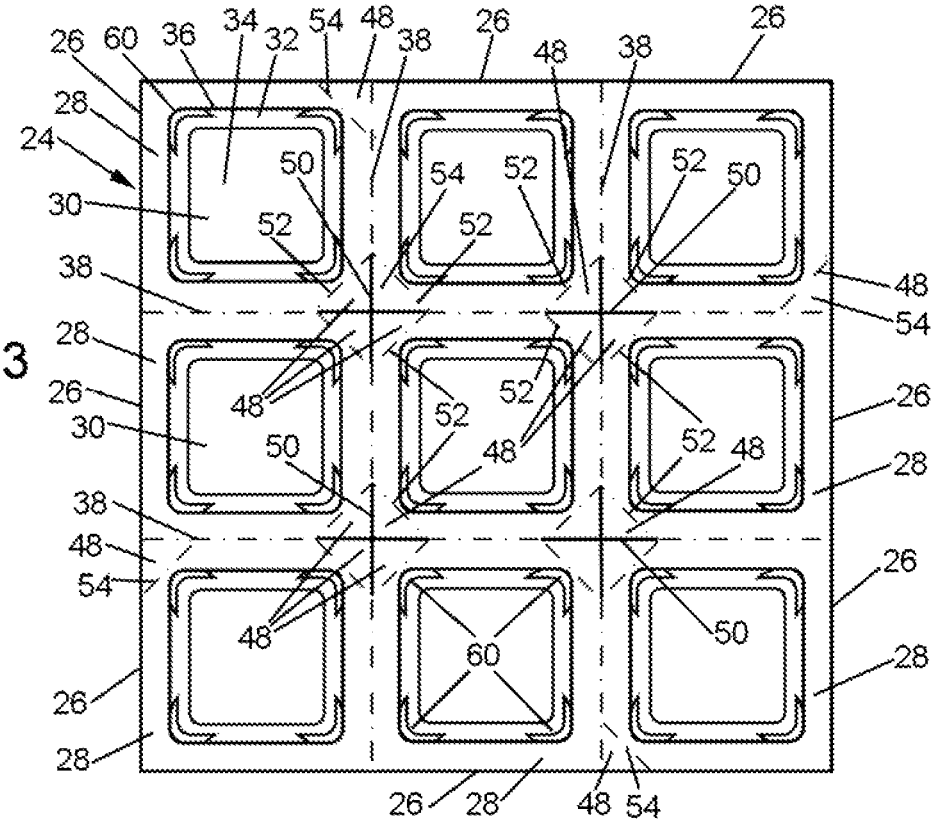
FIG. 3 is a top plan view of the multi-compartment base shown in FIG. 2.
Figure 6:
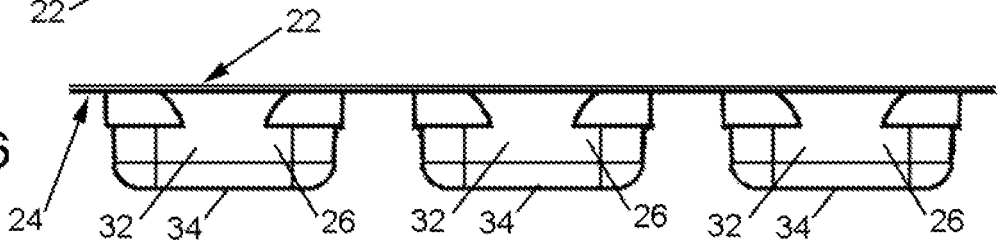
FIG. 6 is a side elevation view of the multi-compartment package shown in FIG. 1.
Figure 7:
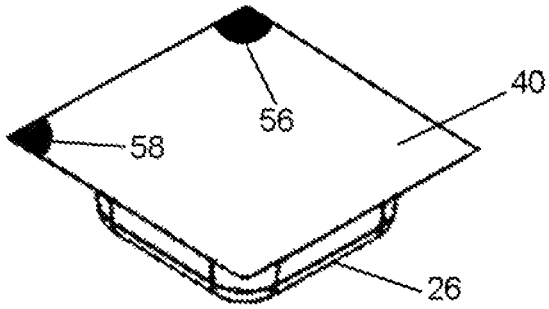
FIG. 7 is an isometric view of one of the sealed compartment units of the package shown in FIG. 1, after it has been separated from the other sealed compartment units of the packages.

The base member 24 is best seen in FIGS. 2, 3 and 6 and includes plural "blister" compartment units 26, each of which is of square profile having a generally planar flange 28 from which a hollow chamber 30 depends downwardly. In this exemplary embodiment each compartment unit is approximately 5.1 cm square. As best seen in FIG. 3, each chamber 30 is also of square profile, with slightly rounded corners, and includes four downwardly extending sidewalls 32 which terminate at a generally planar bottom wall 34. The exemplary embodiment of the package 20 shown in FIGS. 1-9 is configured for holding relatively small items therein. Thus, in this embodiment each of the chambers is approximately 3.8 cm wide, by 3.8 cm high and approximately 1.6 cm deep. That is merely exemplary. In fact, in FIGS. 10 and 11 there is shown an alternatively embodiment of a multi-compartment dispensing package 120 which is deeper to accommodate larger or more items therein. In any case, each chamber of the package 30 includes a square opening 36 (FIG. 2) with rounded corners at its top, which opening is centered in its flange 28. Each chamber is configured to hold one or more drugs, tablets, capsules, liquids, ointments, lotions, botanicals or any other items desired to be packaged for dispensing. The flanges 28 of the compartment units 26 are releasably connected to one another by plural linear, frangible lines 38. In the preferred exemplary embodiment of the package shown in FIG. 1, the package includes nine compartment units 26 disposed in an array of three rows of three columns, with the frangible lines 38 establishing the rows and columns of the array. The compartments units are formed of any suitable material, e.g., a plastic, like that of the blister compartments of the prior art patents cited above.

Figure 4:
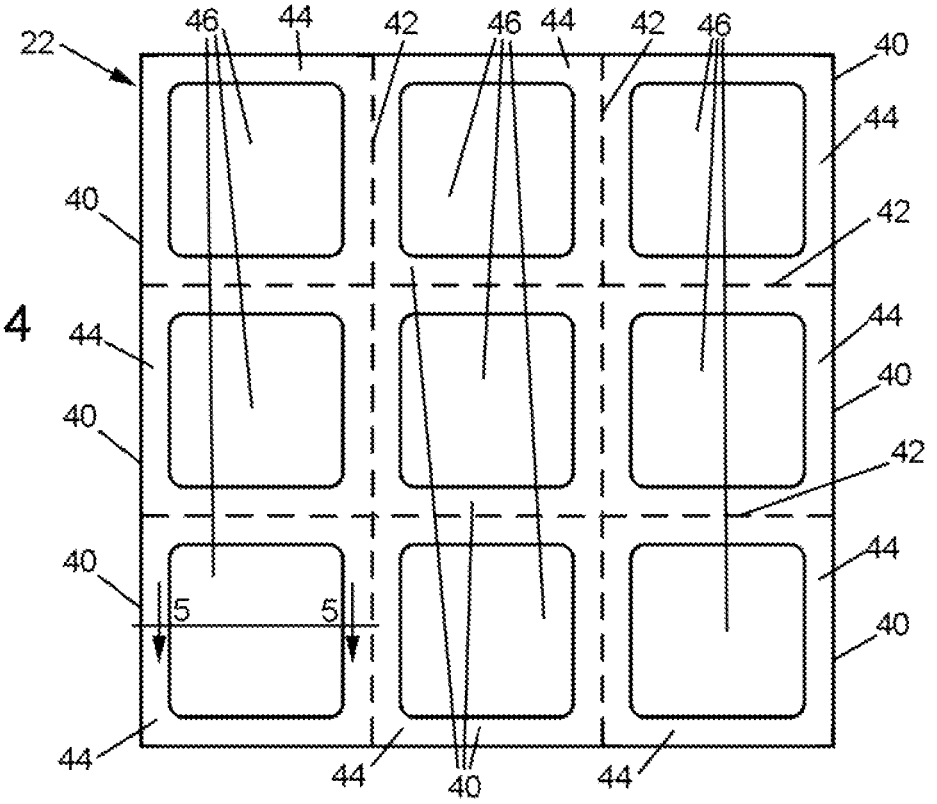
FIG. 4 is a bottom plan view of the frangible cover sheet of FIG. 1.
Figure 5:
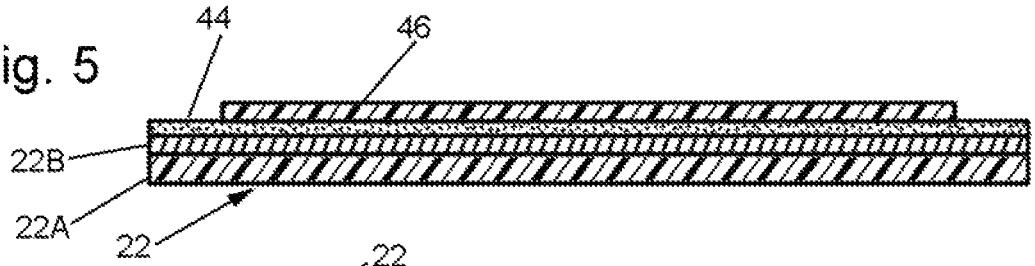
FIG. 5 is an enlarged sectional view taken along line 5-5 of FIG. 4.

Each of the compartment units 26 is configured to be covered and sealed by a respective square closure member 40. In particular, the closure members 40 form respective portions of the cover sheet 22. As can be seen in FIGS. 1 and 4 the cover sheet 22 is a generally planar member of square profile that includes nine cover members 40 disposed in an array of three rows and three columns. The array of cover members is established by plural linear frangible line 42. The cover sheet is coextensive in size with the base member 24 and the frangible lines 42 of the cover sheet are coincident with the frangible lines 38 of the base member.

As best seen in FIG. 4, the undersurface of the closure members 40 of the cover sheet includes areas of a releasably securable adhesive 44 which serve to releasably secure each closure member to a respective one of the compartment units 26. In order to protect the item(s) located within the chamber 30 from engagement with the adhesive 44, the inner surface of each closure member 40 includes a square liner patch 46 with rounded corners disposed over the adhesive 44. Each liner patch 46 is coincident in size to the opening 36 of the chamber 30 over which it is disposed, whereupon no portion of the adhesive 44 will be exposed to the item within the chamber 30.

In accordance with a preferred aspect of this invention the cover sheet 22 is preferably formed as a multi-layer construction or lamination having an outside layer 22A, which may be composed of paper or a plastic, e.g., vinyl. A metal foil layer 22B is disposed under the outside layer. The undersurface of the foil layer 22B includes a layer of the heretofore identified releasably securable adhesive 44. Lastly, the outer surface of the adhesive layer 44 is covered by the liner patch 46.

The liner patches 46 are preferably provided on the exposed surface of the adhesive layer 44 of the cover sheet by means of a releasably securable liner sheet (not shown). The liner sheet includes die cut areas corresponding to the liner patches 46 and disposed in an array of three rows and three columns. The liner sheet is configured to be releasably secured to the adhesive layer 44 of the cover sheet with the array of liner patches 46 disposed over the array of chamber opening 36 in the base member and with the remaining portions of the liner sheet disposed over the remainder of the adhesive of the cover sheet. After the chambers 30 of the base member 22 have been filled with the items to be dispensed the liner sheet can then be removed, e.g., peeled off, of the cover sheet, thereby leaving the liner patches 46 in place on the cover sheet with remaining portions of the adhesive exposed. The cover sheet can then be releasably secured to the base member by the exposed adhesive 44 of the cover sheet 22 engaging the flanges 28 of the compartment units 26 of the base member. This action seals the items in each of the compartment units 26, thereby completing the package 20 so that it is now in the form of plural sealed compartment units which are releasably secured to one another.

At least one corner of each of the flanges 28 of the compartment units 26 includes a triangular shaped tab 48 to facilitate the removal of the closure member from the sealed compartment unit. In particular, each tab is provided to enable the user of the package to fold down that corner of the flange 28 like shown in FIGS. 8 and 9, and as will be described later whereupon the closure member can be grasped at that corner to remove it, e.g., peel it off the underlying flange.

In preferred embodiments of this invention each compartment units includes two triangular shaped tabs in selected ones of the corners of its flange. In particular, as can be seen in FIG. 3 the frangible lines 38 of the base member form respective cruciform shaped frangible separation lines 50 extending through the planar flanges where the frangible lines 38 intersect. A diagonally oriented fold line 52 is contiguous with and connects adjacent ends of the cruciform shaped frangible separation lines at the corners of the flanges 28 where the frangible lines 38 intersect, whereupon the contiguous diagonal fold lines 52 form a diamond shaped area surrounding the cruciform shaped frangible separation lines 50. Thus, the corner of each of the flanges 28 of those compartment units at the intersection of the frangible lines 38 includes a diagonal fold line 52 which together with the contiguous portions of the cruciform shaped frangible separation lines 50 forms a triangularly shaped, foldable tab 48.

As mentioned above, each of the compartment units includes two foldable tabs 48. In fact, each of the compartment units making up the second column of the array of units and each of the compartment units making up the second row of the array of units include four triangularly shaped foldable tabs 48. However, the compartment units 26 at each of the four corners of the base member 24 include only two foldable tabs 48. In particular, the compartment unit 26 at the upper left corner of the base member, i.e., the compartment of the first row and first column, includes a diagonal fold line 54 extending from the top edge of that compartment unit to the frangible line 38 interposed between the first and second columns of the compartment units. Thus, the diagonal fold line 54 forms a second foldable tab 48 of the compartment unit at the upper left corner of the base member. The compartment unit 26 at the upper right corner of the base member, i.e., the compartment of the first row and third column, includes a diagonal fold line 54 extending from the right side edge of that compartment unit to the frangible line 38 interposed between the first and second rows of the compartment units. That diagonal fold line forms a second foldable tab 48 of the compartment unit at the upper right corner of the base member. The compartment unit 26 at the lower right corner of the base member, i.e., the compartment of the third row and third column includes a diagonal fold line 54 extending from the bottom edge of that compartment unit to the frangible line 38 interposed between the second and third columns of the compartment units. That diagonal fold line forms a second foldable tab 48 of the compartment at the lower right corner of the base member. Lastly, the compartment unit 26 at the lower left corner of the base member, i.e., the compartment of the third row and first column includes a diagonal fold line 54 extending from the left side edge of that compartment unit to the frangible line 38 interposed between the second and third rows of the compartment units. That diagonal fold line forms a second foldable tab 48 of the compartment at the lower left corner of the base member. It should be pointed out at this juncture that, if desired, the fold lines 52 and 54 forming the foldable tabs 48 can be frangible lines.

In order to identify the location of the foldable tabs when the cover is in place the cover sheet includes foldable tab-indicating indicia appearing on its upper surface and which are located directly over the foldable tabs 48 of the base member when the cover sheet is in place. Moreover, the location of the foldable tabs is such that the cover sheet can be oriented in any ninety degree orientation with respect to the base member and the respective foldable tab-indicating indicia will still be directly over the foldable tabs 48. Thus, as best seen in FIG. 1, in the exemplary embodiment of the package 20 the foldable tab-indicating indicia consists of respective circular areas 56 located at the intersections of the frangible lines 42. The indicium indicating the location of the foldable tab 48 of the upper left compartment unit is in the form of a quarter segment of a circular area 58. The indicium indicating the location of the foldable tab 48 of the upper right compartment unit is in the form of a quarter segment of a circular area 58. The indicium indicating the location of the foldable tab 48 of the lower right compartment unit is in the form of a quarter segment of a circular area 58. The indicium indicating the location of the foldable tab 48 of the lower left compartment unit is in the form of a quarter segment of a circular area 58. The foldable tab-indicating indicia 56 and 58 can be printed, e.g., laser-printed, on the upper surface of the top layer 22A of the cover sheet.

Figure 8:
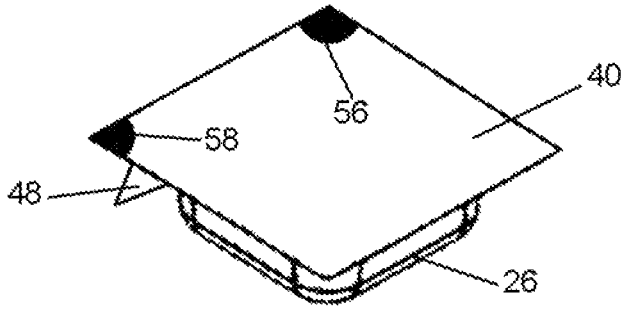
FIG. 8 is an isometric view, similar to FIG. 7, but showing one corner of the base being folded down along a fold line to enable one to readily grasp a corner of the cover disposed thereon to peel that cover off of the base.
Figure 9:
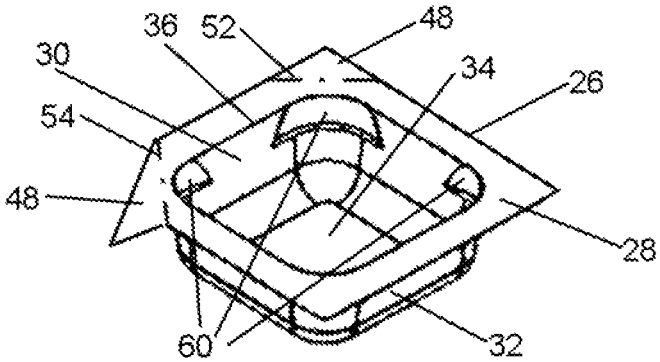
FIG. 9 is an isometric view similar to FIGS. 7 and 8, but showing the base of the separated compartment unit after the cover has been removed therefrom.

Use of the package 20 to dispense the item held within any of the sealed compartment units is as follows. The particular sealed compartment may be separated from the remaining compartments of the base member by tearing or otherwise breaking the coincident frangible lines 42 and 38 which connect that unit to the remaining units. That action results in a separated sealed compartment unit, like shown in FIG. 7. That figure shows the sealed compartment unit at the lower right corner of the package having been removed from the other sealed compartment. In order to provide access to the item within the chamber of that compartment unit the closure member 40 which is adhesively secured to the flange 28 of that compartment unit must be removed, e.g., peeled off, of the flange. To expedite that action the user can fold down either of the two foldable tabs 48 of that compartment unit. In FIG. 8, the tab 48 at the location of the lower edge of the cover sheet and the frangible line 42 separating the second and third columns of compartment units is chosen and is folded down as shown therein. That action exposes the corner of the closure member 40 disposed over the folded down corner, whereupon that corner of the closure member can be readily grasped by the user to remove, e.g., peel, the closure member from the flange of the compartment unit, thereby exposing the item in the chamber.

In accordance with one preferred aspect of this invention the base members are constructed so that they can be nested together to stack them up and thereby save space until they are ready to be filled with items and thereafter sealed. To that end the sidewalls 32 of each of the chambers 30 taper slightly inward toward each other in the direction towards the bottom wall 34. In addition, as best seen in FIGS. 2 and 3 each of the chambers 30 includes a planar ledge portions 60 located slightly below the surrounding flange 28 in each corner of the chamber and upon which the bottom wall 34 of another base member can be disposed (supported) to nest the base members together.

The base member 22 can be constructed of any suitable commercially available plastic material that exhibits good moisture resistance. Examples of some suitable materials are pharmaceutical grade thermoformable rigid PVC plastic films, like Pentapharm® PH-M57/04 film sold by Klöckner Pentaplast of America, Inc. or Pentapharm® alfoil Polymer film P-250/40 also sold by Klöckner Pentaplast of America, Inc. or thermoformable rigid PVC films like Perlalux® Mono sold by Perlen Converting AG of Perlen Switzerland or Perlalux®—Duplex 500.40 (C) UV also sold by Perlen Converting AG. Other plastic materials can be used as well, depending upon the items/products to be held within the compartments of the base member, providing that such materials exhibit the following characteristics: ability to be printed by an ink-jet printer or preferably a laser printer; and the ability to lay flat, both prior and post printing.

With respect to the cover sheet, as mentioned earlier it can be a lamination of paper or plastic and a metal foil, with an adhesive on the undersurface of the foil layer and with a release liner. One example of such a cover sheet materials is sold by Nastar Incorporated of Middleton, Wis. under Product Code XYH3281XP-RB. Another example is sold by Green Bay Packaging, Inc. of Green Bay, Wis. under Product Code 055RF00751PBLF Product Foil. For applications in which the package will be used to hold ointments, creams, lotions and the like, it is anticipated that the cover sheet will be constructed of a plastic material such as top-coated vinyl having an adhesive undersurface. One example of such a top-coated vinyl material is Fasson® Laser Code™ Drum Label TC/s4600/79#MF available from Avery Dennison Corporation. A suitable adhesive is Fasson® 54600 adhesive available from Avery Dennison Corporation.

Figure 10:
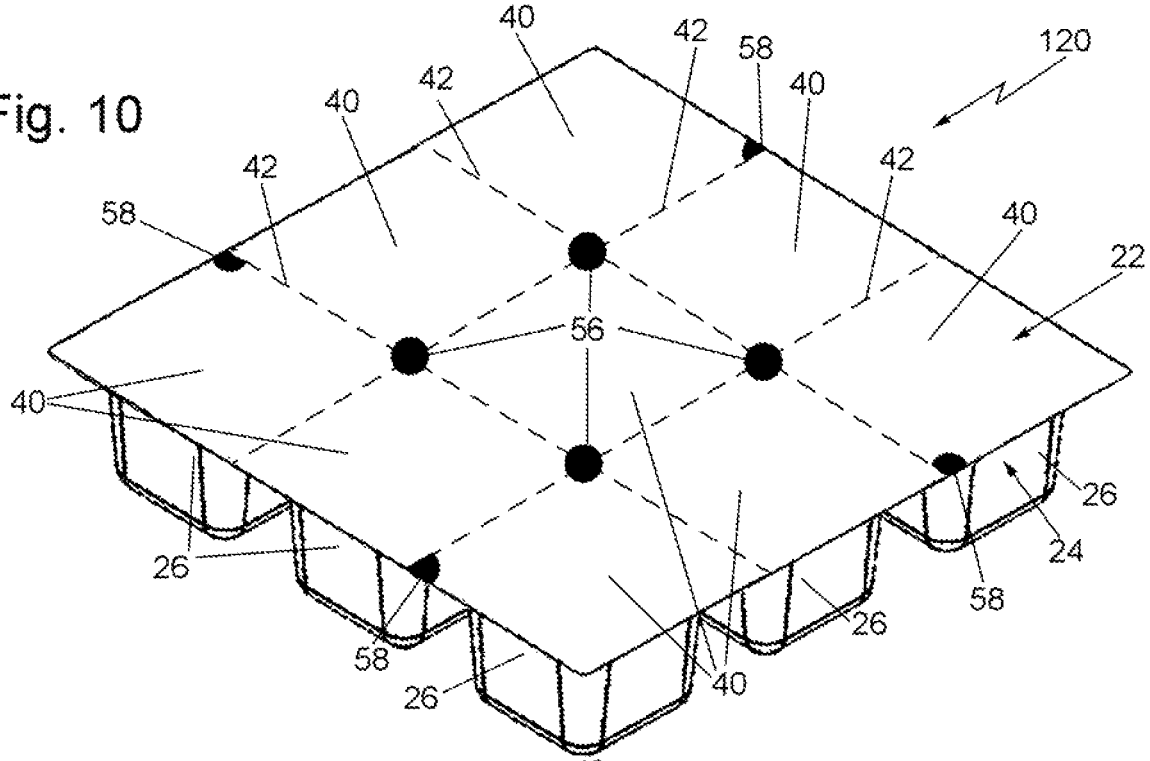
FIG. 10 is an isometric view of another exemplary embodiment of multi-compartment dispensing package constructed in accordance with this invention, wherein the package includes a frangible cover sheet made up of plural covers and a frangible multi-compartment base which is deeper than the base of FIG. 1 and on which the cover sheet is adhesively secured.
Figure 11:
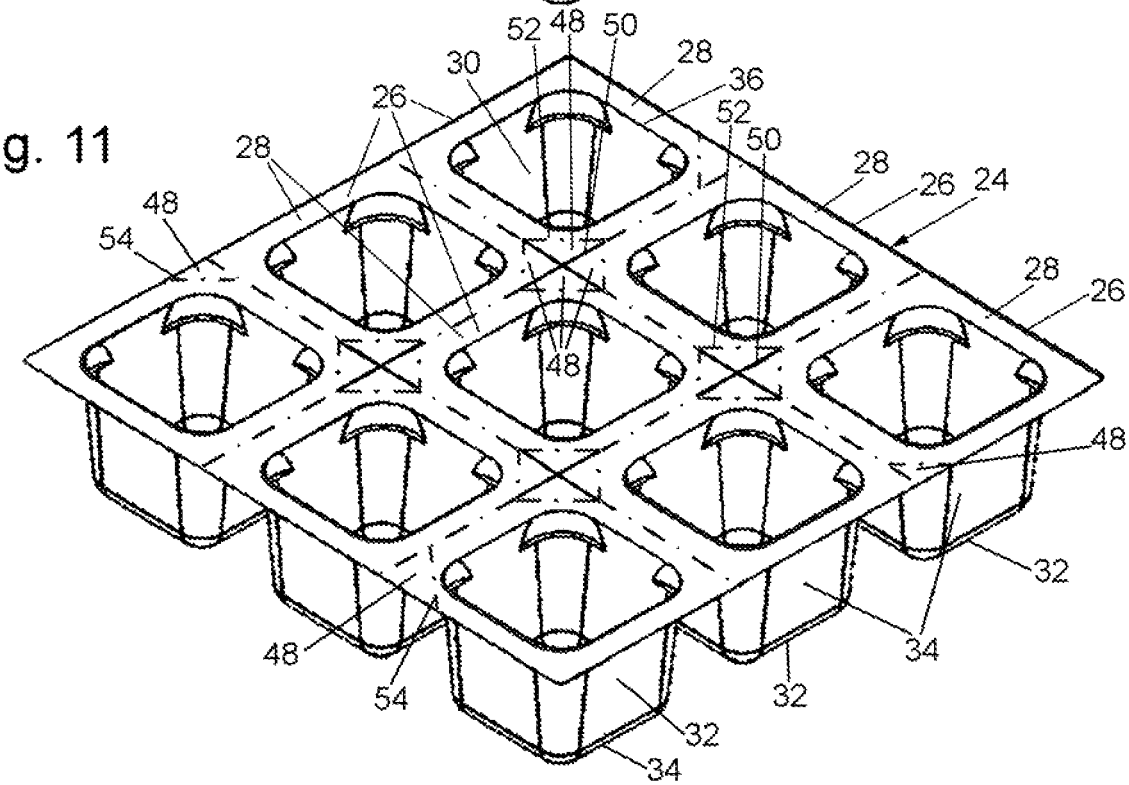
FIG. 11 is an isometric view of the deeper base of FIG. 10.

As mentioned above FIGS. 10 and 11 represent an alternative embodiment of a multi-compartment dispensing package 120 constructed in accordance with this invention. The package 120 is identical in all respects to the package 20, except for the depth of the chambers of the base member. In the interest of brevity the features or components of the package 120 which are common with the features or components of the package 20 will be given the same reference numbers and the details of the construction and function of those features or components will not be reiterated herein. Thus, as can be seen in FIGS. 10 and 11, the package 120 is made up of a cover sheet 22 and a base member 24. The depth of each chamber 30 of the package, i.e., the height of its side walls 32 is approximately 3.2 cm.

It should be pointed out at this juncture that the two embodiments as described above are merely exemplary of various embodiments of this invention which are contemplated. Thus, it is contemplated that multi-compartment packages can be constructed in accordance with this invention having only two rows and two columns of compartment units, or other packages can be constructed with more than three rows and three columns of compartment units. Moreover, while it is preferred that each compartment unit have two foldable tabs for facilitating the removal of the cover member of the compartment unit, that is merely exemplary. Thus, the subject invention contemplates multi-compartment dispensing packages, having plural compartment units, each of which has one foldable tab or more than two foldable tabs. Moreover, the size and shape of the chambers 30 can be different than that disclosed above with reference to the exemplary embodiments of the packages 20 and 120. For example, the chambers 30 may be other than square shape, e.g., they may be of circular, oval, triangular, or any other shape, providing that the flange surrounding the chamber is square. Also the dimensions of the chambers can be different from that disclosed above, In fact, the dimensions of the base units 26 and cover member 40 can be different than that disclosed above, e.g., can be greater or lesser than 5.1 cm square.

Further still, the cover sheet 22 may be constructed differently than the example described above. For example, instead of making use of a releasably securable adhesive extending over the entire undersurface of the foil layer 22B and with liner patches 46 located where the openings 36 of the chambers 30 are located, the adhesive 44 on the undersurface of the foil layer 22B may be a patterned adhesive. By that it is meant that the adhesive is applied in a pattern on the undersurface of the foil layer so that it is located only in the areas where the flanges 28 of the base member 22 are located. Thus, the portions of the undersurface of the foil layer within the bounds of the pattern adhesive forming the flange engaging portions of the cover sheet, i.e., the portions of the undersurface of the foil which will overlie the openings to the chambers will not have any adhesive thereon. Furthermore, if desirable, and depending upon the application and the item/product to be held within the chambers 30, the material making up the cover sheet 22 may not include a metal foil layer 22B, e.g., the cover sheet may merely be a plastic layer, whose undersurface includes the releasably securable adhesive, whether applied in the form of a patterned to only engage the flanges of the base member, or over the entire undersurface and with liner patches disposed over the openings to the chambers.

Without further elaboration the foregoing will so fully illustrate our invention that others may, by applying current or future knowledge, adopt the same for use under various conditions of service.

We claim:

1. A base member for use in a dispensing package holding an item therein, the dispensing package including a square shaped cover sheet, said base member comprising: a plurality of individual compartment units releasably secured to one another and disposed in an array of at least three rows and three columns forming a multi-compartment base, each individual compartment unit being of a square profile and comprising a flange and a chamber depending from said flange, said flange extending around the periphery of said chamber and having four corners, each of said flanges comprising two fold lines adjacent selected ones of said four corners, said multi-compartment base comprising at least one central inside individual compartment unit surrounded by outer individual compartment units, said outer individual compartment units having a peripheral edge formed by respective outer side edges of said outer individual compartment units, with four of said outer individual compartment units forming respective corners of said base member, said flange of said outer individual compartment units having only two fold lines, with neither of said only two fold lines being located at a corner of said base member, adjacent ones of said individual compartment units merging together at a respective cruciform shaped frangible separation line, said cruciform shaped frangible separation line including respective portions of a selected corner of each of said individual compartment units, said selected corner of each of said individual compartment units including a fold line contiguous with said cruciform shaped frangible separation line, said flanges of said multi-compartment base being detachably connected along frangible separation lines connecting said corners so that each individual compartment unit may be separated from other individual compartment units, whereupon the selected corner of the individual compartment unit detached from the other individual compartment units can be folded downward.

2. The base member of claim 1 wherein said base member is configured to be adhesively secured to the cover sheet by an adhesive interposed between the cover sheet and said flanges of said base member.

3. The base member of claim 1 wherein said each of said individual compartment units is approximately 5.1 cm square and the opening of each of said chambers is approximately 3.8 cm wide, by 3.8 cm high.

4. The base member of claim 3 wherein the depth of each of said chambers is approximately 1.6 cm.

5. The base member of claim 3 wherein the depth of each of said chambers is approximately 3.2 cm.

6. The base member of claim 1 wherein each of said chambers comprises four side walls and a bottom wall, said sidewalls tapering slightly inward toward each other in the direction towards said bottom wall.

7. The base member of claim 6 wherein each of said chambers includes a ledge portion located slightly below said flange upon which a bottom wall of another base member can be supported.

8. A dispensing package comprising the base member of claim 1 and a square shaped cover sheet, said square shaped cover sheet having a plurality of closure members disposed in an array of at least three rows and three columns releasably secured to one another along frangible separation lines, whereupon said frangible separation lines of said cover sheet being coincident with said frangible separation lines of said base member and respective ones of the closure members are releasably secured to respective ones of said individual compartment units to form respective sealed compartment units with an item disposed therein, each of said sealed compartment units being configured to be detached from said other sealed compartment units.

9. The dispensing package of claim 8, wherein said cover sheet includes indicia thereon, said indicia being configured to be located at respective portions of said cover sheet corresponding to the location of said foldable lines of said base member irrespective of the orientation of said cover sheet with respect to said base member.

10. The dispensing package of claim 9, wherein said cover sheet comprises an outer layer, a foil layer, an adhesive layer and a liner layer, said liner layer comprising plural liner patches covering said adhesive layer and located at respective opening of said base member.

11. The dispensing package of claim 10 wherein said outer layer is formed of paper.

12. The dispensing package of claim 10 wherein said outer layer is formed of a plastic material.

13. The dispensing package of claim 10 wherein said outer layer includes an upper surface having indicia appearing thereon, said indicia being configured to be located at respective portions of said cover sheet corresponding to the location of said foldable lines of said base member irrespective of the orientation of said cover sheet with respect to said base member.

* * * * *